US005261843A

United States Patent [19]

Tsujii et al.

[11] Patent Number: 5,261,843

[45] Date of Patent: Nov. 16, 1993

[54] TRIM/TILT DEVICE FOR MARINE PROPULSION UNIT

[75] Inventors: Eiichiro Tsujii, Hamamatsu; Yoshiyuki Katsumata, Numazu, both of Japan

[73] Assignee: Sanshin Kogyo Kabushiki Kaisha, Hamamatsu, Japan

[21] Appl. No.: 904,004

[22] Filed: Jun. 24, 1992

[30] Foreign Application Priority Data

Jul. 31, 1991 [JP] Japan ..... 3-214806
Jul. 31, 1991 [JP] Japan ..... 3-214807

[51] Int. Cl.[5] ..... B63H 21/26
[52] U.S. Cl. ..... 440/61; 188/284
[58] Field of Search ..... 440/61; 91/420; 188/284, 299

[56] References Cited

U.S. PATENT DOCUMENTS 3,962,955 6/1976 Borst et al. .
5,030,147 7/1991 Binversie et al. ..... 440/61

FOREIGN PATENT DOCUMENTS 56-53992 5/1981 Japan .
58-174093 10/1983 Japan .
59-190089 10/1984 Japan .
2-5638 2/1990 Japan .

*Primary Examiner*—Jesus D. Sotelo
*Attorney, Agent, or Firm*—Ernest A. Beutler

[57] ABSTRACT

Two embodiments of concentric tilt and trim cylinder arrangements for machine propulsion units for achieving trim and tilt-up operation. Each embodiment includes an arrangement that permits the outboard drive to pop up when an underwater obstacle is struck, but which preclude popping up operation when operating in reverse. In addition, one embodiment incorporates an arrangement for ensuring against inadvertent trim up when trim down is being called for.

22 Claims, 5 Drawing Sheets

TRIM/TILT DEVICE FOR MARINE PROPULSION UNIT

BACKGROUND OF THE INVENTION

This invention relates to a trim/tilt device for a marine propulsion unit and more particularly to an improved hydraulically operated tilt and trim arrangement.

It has been known to mount marine outboard drives such as an outboard motor per se or the outboard drive unit of an inboard/outboard drive on the transom of the hull for movement between a plurality of trim adjusted positions and also for movement to a tilted up out-of-the-water position. Conventionally it has been the practice to employ fluid motors for achieving both the trim and tilt-up operation. A first trim hydraulic motor is mounted on the transom and has a piston rod in abutting relationship with a portion of the outboard drive unit for achieving the trim adjustment. In addition, a tilt cylinder is connected pivotally to the transom and to the marine outboard drive and when actuated causes tilt-up operation.

It is generally the practice to provide a relatively higher power but lower speed hydraulic motor for the trim adjustment than for the tilt movement. The reason for this is the trim adjustment is normally made under running with the outboard drive generating significant driving thrust against which the trim cylinder must operate. The tilt cylinder, on the other hand, only need lift the weight of the outboard drive above the water. It has generally been the practice to incorporate a hydraulic circuit that will accomplish first the trim adjustment and then when the trim cylinders are at the end of their stroke, a tilt movement. Of course, this type of arrangement provides a relatively complicated structure and incorporates at least two fluid motors each of which has a piston rod that is exposed at the rear of the transom to the marine environment, which can obviously cause corrosion problems.

In order to simplify the construction and operation, it has been proposed to employ an arrangement wherein the trim and tilt cylinders are formed within a common concentric unit. This unit includes a cylinder housing that is affixed to the transom and which defines an internal chamber that is divided into two cylinder portions by a trim piston. The trim piston itself defines an internal chamber in which a tilt piston is slidably supported to define two trim piston chamber portions. The chamber portions of the trim piston and cylinder are communicated with each other at their respective ends. As a result, a hydraulic circuit can be employed which will pressurize both the tilt and trim pistons until the trim piston is at the end of its stroke and then tilt-up operation will be achieved by continued movement of the tilt piston within the trim piston.

It is also the practice with this type of arrangement to incorporate a shock absorbing structure, generally in the tilt piston, so as to permit the outboard drive to pop up when an underwater obstacle is struck. However, when this is done with the single concentric assembly of the type described in the preceding paragraph, the outboard drive can also pop up when operating under reverse thrust conditions.

With a conventional system employing separate tilt and trim cylinders, the shock absorbing structure within the trim cylinder will resist popping up under reverse operation. However, with the concentric type of device previously described, when operating in reverse mode, the tilt piston tends to be drawn upwardly within the trim piston. This causes a transfer of fluid from the tilt piston chamber portion to the corresponding cylinder chamber portion through the open passageway that exists between these chamber portions. This causes the tilt piston to be driven downwardly so as to accommodate this fluid flow and the outboard drive can easily move up under reverse thrust, an obviously undesirable situation.

It is, therefore, a principal object of this invention to provide an improved concentric tilt/trim cylinder arrangement for a marine outboard drive that can resist reverse thrust operation while at the same time permit popping up when an underwater obstacle is struck.

It is a further object of this invention to provide an improved concentric tilt and trim cylinder arrangement for a marine outboard drive that does not have the deficiencies of prior art type constructions.

As has been previously noted, the prior art type of concentric tilt and trim cylinders have operated in such a way that the trim piston moves through its full upstroke simultaneously with the tilt piston and when the trim piston reaches the end of its stroke, the tilt piston will continue to move upwardly but at a higher speed and with a lower force. Reverse operation occurs in the opposite direction. That is, when tilting down the tilt piston is forced downwardly along with the trim piston until the tilt piston reaches the bottom of its stroke and then the trim piston will continue to move through the remainder of its stroke. However, when a down force is exerted and the device is not in its fully tilted-up position, another problem can occur with the prior art type of devices. That is, a fluid pressure is exerted first in the chamber portion of the cylinder above the trim piston and as the trim piston is forced downwardly, the pressure in the opposite portion of the cylinder chamber will rise. The downwardly action hydraulic force must pass to the tilt piston through a restricted opening and the downward pressure on the tilt piston will not rise as rapidly as it is on the trim piston. However, the fluid pressurized in the under side of the assembly will act upon the tilt piston and at times this pressure can be higher than the downward pressure on the tilt piston. Thus even though the operator desires to trim the outboard drive downwardly, it will initially rise. This is obviously a disadvantage.

It is, therefore, a still further object of this invention to provide an improved hydraulic circuitry for actuating a concentric tilt and trim cylinder assembly.

It is a further object of this invention to provide a tilt and trim cylinder assembly of the concentric type wherein it will be ensured that trim down operation is always accomplished the instant it is called for.

SUMMARY OF THE INVENTION

The features of the invention are adapted to be embodied in a tilt and trim cylinder for a marine propulsion unit that comprises a cylinder assembly defining an internal chamber. A trim piston is received in the cylinder assembly chamber and divides the cylinder chamber into first and second portions. The trim piston is formed with an internal chamber and a tilt piston is received in the trim piston chamber and defines first and second portions of the trim piston chamber. First means communicates the first portion of the cylinder chamber with the first portion of the tilt piston chamber. Second communication means communicates the second cylinder chamber portion with the second trim piston chamber portion.

In accordance with a first feature of the invention, means are provided for precluding flow through the second communication means from the second tilt piston chamber portion to the second cylinder chamber portion until a predetermined condition is reached.

In accordance with a second feature of the invention, means are provided for precluding a rapid pressure increase in the second cylinder chamber portion that would cause a higher pressure to exist on the first tilt piston chamber portion of the trim piston than on the second tilt piston chamber portion due to the restriction of the second conduit means for precluding movement of the tilt piston in a direction opposite to that desired.

DETAILED DESCRIPTION OF THE PREFERRED EMBODIMENTS OF THE INVENTION

Figure 1:
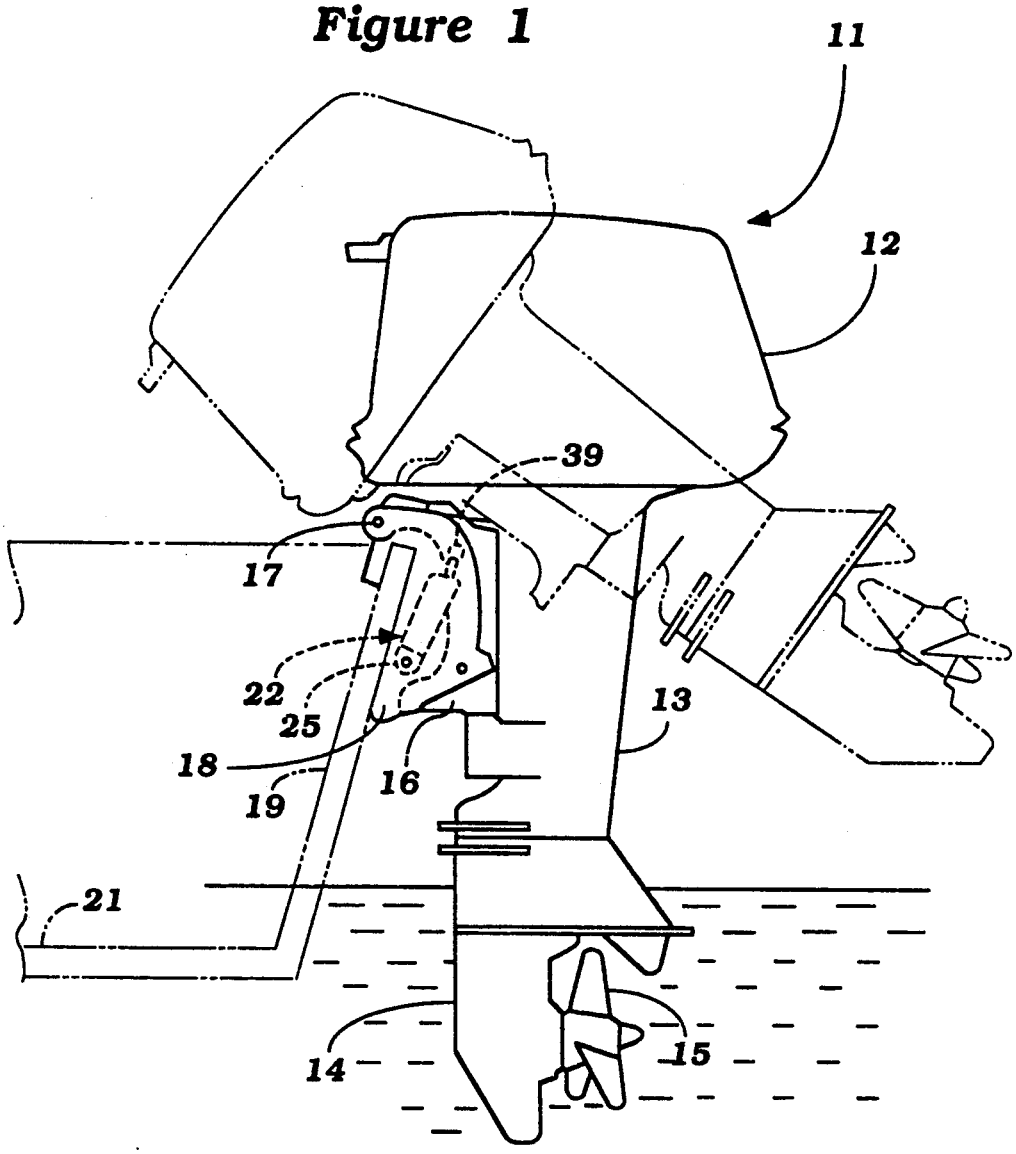
FIG. 1 is a side elevational view of an outboard motor embodying a tilt and trim device in accordance with an embodiment of the invention, as attached to the transom of a watercraft, shown in phantom, with the outboard motor being shown in its normal running condition in solid lines and in its tilted up out-of-the-water condition in phantom.

Referring first in detail to FIG. 1, a marine outboard drive in the form of an outboard motor is identified generally by the reference numeral 11. As has been previously noted, the term "outboard drive" is intended to encompass outboard motors or the outboard drive portion of an inboard/outboard drive.

The outboard motor 11, as is typical with outboard motor practice, includes a power head 12 containing a powering internal combustion engine that is surrounded within a protective cowling. The engine (not shown) is supported so that its output shaft rotates about a vertically extending axis and drives a driveshaft (not shown) that is journaled for rotation within a driveshaft housing 13. The driveshaft housing 13 depends from the power head 12 and terminates in a lower unit 14. The driveshaft depends into the lower unit 14 and drives a propeller 15 through any conventional type of forward/neutral/reverse transmission contained within the lower unit 14.

A steering shaft (not shown) is affixed to the driveshaft housing 13 in a suitable manner and is journaled for steering movement about a vertically extending steering axis within a swivel bracket 16. The swivel bracket 16 is, in turn, pivotally connected by means of a pivot pin 17 to a clamping bracket 18. The clamping bracket 18 is affixed in a suitable manner to a transom 19 of a watercraft shown partially in phantom at 21 in a known manner. The pivot pin 17 accommodates tilt and trim movement of the outboard motor 11 between a plurality of trim adjusted positions for changing the angle of attack of the propeller 15 relative to the transom 19 and to a tilted up out-of-the-water position, as shown in phantom in FIG. 1. A hydraulic tilt and trim device embodying this invention is identified generally by the reference numeral 22 and achieves this operation.

The tilt and trim device 22 will now be described in more detail by particular reference to FIGS. 2-4. The tilt and trim device 22 includes an outer cylinder assembly, indicated generally by the reference numeral 23, which is provided with a trunnion portion 24 for offering a pivotal connection to the clamping bracket 18 by means of a pivot pin 25 (FIG. 1).

The interior of the cylinder assembly 23 defines an internal chamber 26 that is divided into an upper portion 27 and a lower portion 28 by means of a trim piston 29 that is slidably supported within the chamber 26.

The trim piston 29 is, in turn, formed with an internal chamber 31 defined by a cylinder bore and in which a tilt piston 32 is slidably supported. The tilt piston 32 divides the chamber 31 into an upper portion 33 and a lower portion 34. The tilt piston 32 has affixed to it an integral piston rod 35 that extends through the upper chamber portion 33 and through a bore 36 formed in the end of the trim piston 29 and a bore 37 formed in the end of the cylinder 23. Suitable seals (not shown) are provided between the bores 36 and 37 and the piston rod 35. A trunnion portion 38 is formed integrally with the exposed end of the piston rod 35 and is connected by means of a pivot pin 39 (FIG. 1) to the swivel bracket 16.

In order to permit the outboard motor 11 to pop up when an underwater obstacle is struck, an absorber passage 41 extends through the tilt piston 32 from the chamber portion 33 to the chamber portion 34 and a pressure responsive absorber valve 42 controls the flow through this passage. In order to permit the outboard motor 11 to return to its normal position once the underwater obstacle is cleared, a light return check valve 43 is provided in another passage in the tilt piston 32 so as to accommodate flow from the chamber portion 34 to the chamber portion 33. To ensure that the outboard motor 11 returns to its previously set trim adjusted position, a floating memory piston 44 is provided in the chamber portion 34 and is normally engaged with the tilt piston 32 when operating in a steady state condition. This type of construction is well known in this art.

The bore forming the chamber 31 extends through the lower end of the trim piston 29 and the tilt piston 32 and floating memory piston 44 are retained within this bore by means of a snap ring 45. The snap ring 45, however, permits free communication between the cylinder chamber portion 28 and the trim piston chamber portion 34.

The trim piston chamber portion 33 and cylinder chamber portion 27 are communicated, as with the prior art type of devices, by means of a plurality of passages 46 formed in the end of the trim piston 29. With the prior art type of constructions, the passages 46 have been generally open. However, in accordance with an important feature of the invention, there are provided ball-type check valves 47 in the passages 46 which are urged normally to a closed position by coil compression springs 48 held in place by a retainer plate 49 having passages 51 that communicate the trim piston chamber portion 33 with the passages 46. The ball-type check valves 47 normally preclude flow from the trim piston chamber portion 33 to the cylinder chamber portion 27 but permit flow in the opposite direction when there is an appropriate pressure difference.

A device is provided for automatically opening the check valves 47 at a predetermined position in the stroke of the trim piston 29. This arrangement includes a valve actuating plate 52 that is held axially on a cylindrical extension 53 of the trim piston 29 by means of a snap ring 54. A plurality of actuating pins 55 extend through restricted portions 56 at the end of the passages 46 and which are normally held in engagement with the actuating plate 52 by the action of the coil springs 48 on the balls 47. The pins 55 pass with a clearance through the restricted opening 56 so as to permit fluid flow while at the same time offering a means for actuating the ball valves 47 to their opened position.

Figure 2:
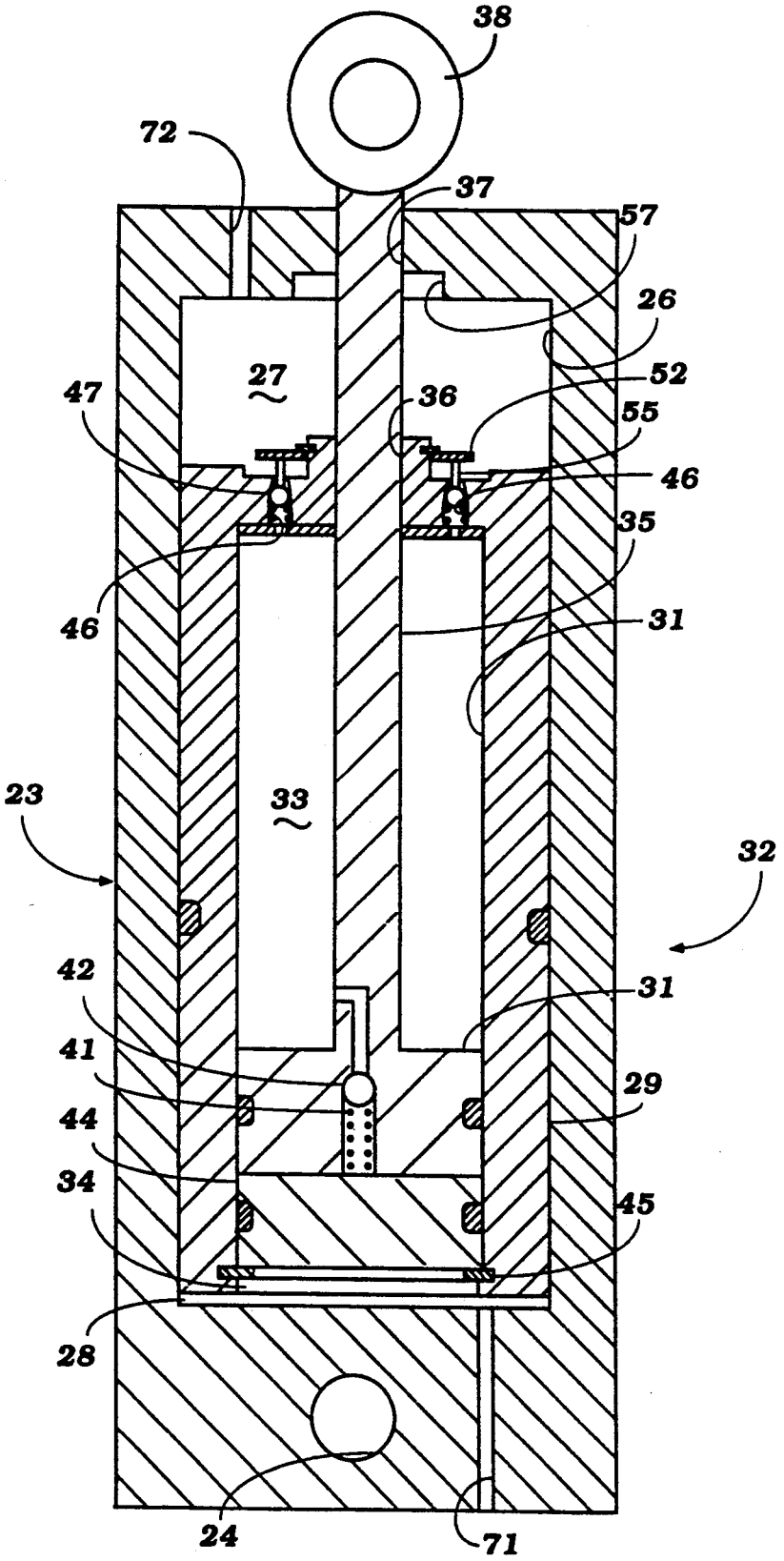
FIG. 2 is an enlarged cross-sectional view taken through the tilt and trim device.
Figure 3:
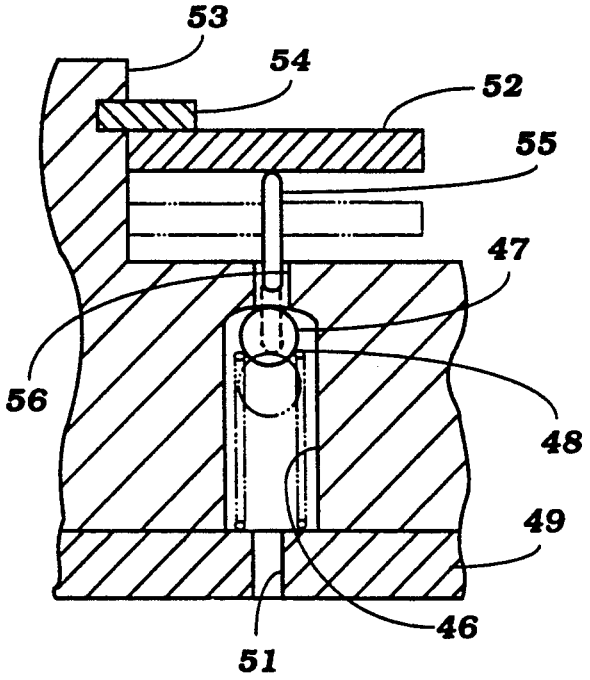
FIG. 3 is a further enlarged cross-sectional view showing how the check valve is operated at the end of the trim stroke of the trim piston.

As may be best seen in FIG. 2, the end of the cylinder 23 is provided with a counterbore 57 which is sized so as to pass the trim piston projection 53 but which will engage the valve plate 52 when the trim piston 29 reaches the end of its stroke as shown in the phantom line view of FIG. 3. In this condition, the ball check valves 47 will be urged to their opened position.

The function of the ball check valves 47 will now be described and this deals with the operation when operating in reverse thrust. In reverse thrust, the trim piston 29 will normally be positioned somewhere between its lowermost position as shown in FIG. 2 and its uppermost position wherein the valve actuating plate 52 will be engaged. In such positions and when operating in reverse, a force is placed on the piston rod 35 tending to draw it upwardly in the chamber 31 to compress the fluid in the chamber portion 33. If the check valves 47 were not provided, this upward movement of the tilt piston 32 would cause fluid to flow from the chamber portion 33 into the cylinder chamber portion 27. This would cause the pressure in the chamber portion 27 to increase and effect a downward force on the trim piston 27 to move it downwardly and force fluid from the chamber portion 28 into the trim piston chamber portion 34 to make up for the volume of the fluid displaced from the trim piston chamber portion 33. In other words, the outboard motor 11 could easily move up under reverse thrust. Because of the normally closed position of the ball check valves 47, however, the outboard motor 11 cannot pop up under reverse thrust unless sufficient force is generated so as to open the absorber valve 42.

However, when traveling forward and when an underwater obstacle is struck with sufficient force, the absorber valve 42 may open and the tilt piston 32 may move upwardly in a direction so as to dampen the popping up operation. When this occurs, the check valves 47 will be held in their closed position and the fluid will merely flow from the trim piston chamber portion 3 to the trim piston chamber portion 34 above the floating piston 44 through the absorber valve 42 and absorber passages 41. When the underwater obstacle is cleared, the weight of the outboard motor 11 will drive the tilt piston 32 back downwardly into engagement with the floating piston 44 so as to return to its previously trim adjusted position. Fluid flows through the return passage 43 during this operation.

The hydraulic circuit for achieving the power trim and tilt adjustment will now be described by particular reference to FIG. 4. This system includes a reversible fluid pump 58 which normally will be positioned within the hull 21 of the watercraft, as are the controls for it. The pump 58 is driven by a reversible electric motor (not shown) and has a pair of ports 59 and 61 with the port 59 operating as the up port and the port 61 operating as the down port. The ports 59 and 61 communicate with respective conduits 62 and 63 that extend to opposite ends of a shuttle valve assembly, indicated generally by the reference numeral 64, and in which a shuttle piston 65 is positioned.

The shuttle valve assembly 64 includes a pair of check valves 66 and 67 which respectively permit flow from the pump conduits 62 and 63 to an up conduit 68 and a down conduit 69. The up conduit 68 communicates with a port 71 formed in the lower end of the cylinder assembly 23 and which communicates with its chamber portion 28. The conduit 69 communicates with a port 72 formed in the head of the cylinder 23 and which communicates with its chamber portion 27.

The conduits 62 and 63 communicate with the fluid reservoir, shown schematically at 73, through passages in which makeup check valves 74 and 75, respectively, are positioned. In addition, relief check valves 76 and 77 communicate the pump ports 59 and 61, respectively, with the reservoirs 73.

A further common relief valve 78 is provided in a conduit 79 that interconnects the conduits 68 and 69 upstream of the ports 71 and 72. Oppositely acting check valves 81 and 82 are provided in the conduit 79 between the relief valve 78 and the conduits 68 and 69 respectively. As a result, the relief valve 78 may control the pressure in either of the lines 68 and 69.

Figure 4:
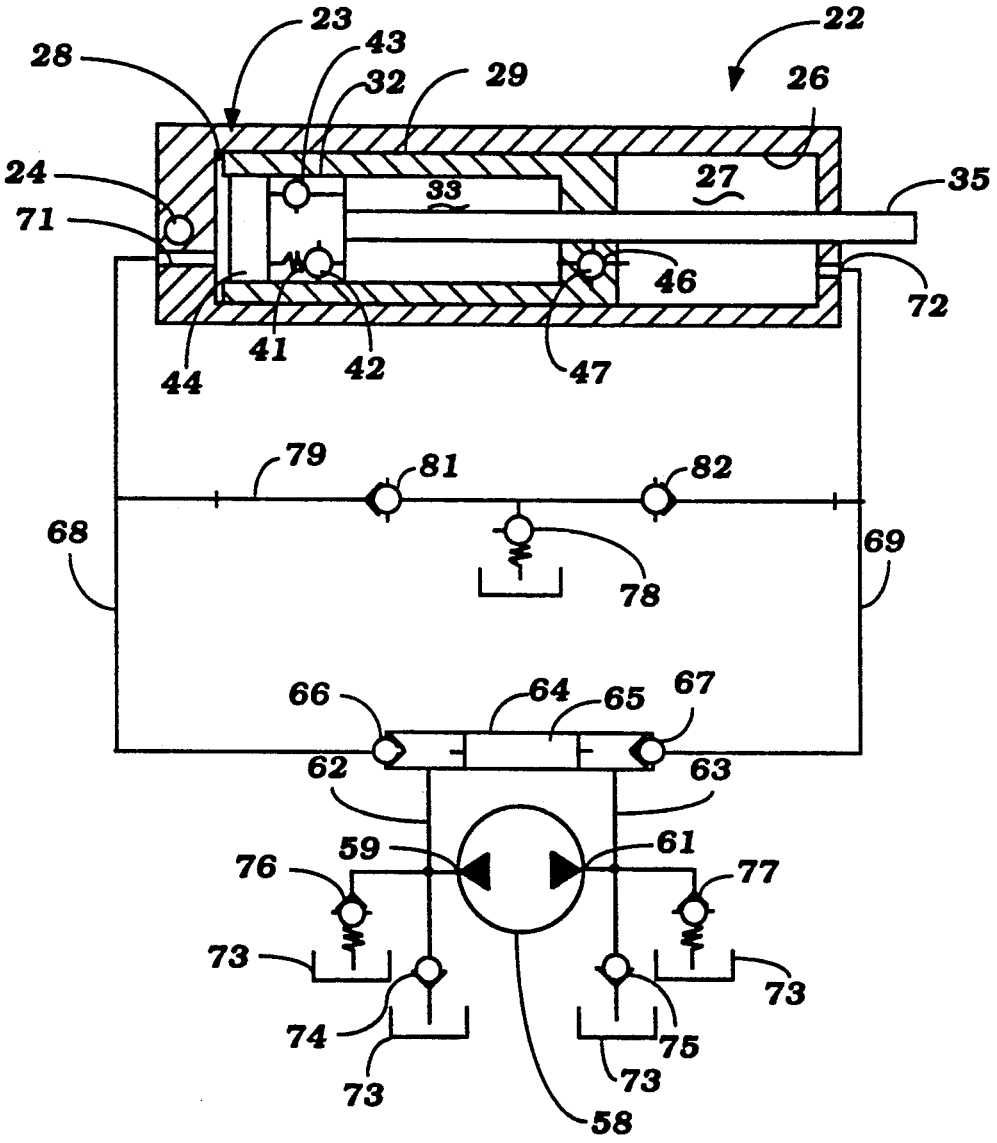
FIG. 4 is a schematic view showing the hydraulic circuitry associated with this embodiment.

FIG. 4 shows the construction when the outboard motor 11 is in its fully tilted down and fully trimmed down position. In order to achieve either trim and/or tilt up, the operator operates an appropriate control (not shown) so as to drive the fluid pump 58 and its powering electrical motor in a direction so that the port 59 acts as the outlet port and the port 61 acts as the return port. The line 62 will then be pressurized and the shuttle piston 65 will be urged to the right as shown in Figure 4 to open or unseat the check valve 67.

The fluid pressure acting on the left hand side of the shuttle piston 65 will be sufficient to open the check valve 66 and fluid will flow into the conduit 68 and port 71. This pressure will then act in the cylinder chamber portion 28 on both the trim piston 29 and tilt piston 32 through the floating piston 44. Since the valve actuating plate 52 will be spaced from the end of the cylinder 23, the ball check valves 47 will be maintained in their closed position and the trim cylinder chamber portion 33 will be hydraulically locked. As a result, both the trim piston 29 and tilt piston 32 will move upwardly together.

When this occurs, fluid will be forced out of the cylinder chamber portion 27 and port 72 to the line 69. This fluid can return to the pump port 61 through the check valve 67 of the shuttle valve 64 which, as has been previously noted, is held in the opened position by the shuttle piston 57. If makeup fluid is required, it can be drawn from the reservoir 73 through the check valve 75.

It should be noted that the aforenoted motion occurs at a relatively low speed since the effective area of the trim piston 29 is substantially large. As a result, trim up operation can be accomplished even if the outboard motor 11 is propelling the boat 21 forwardly at a high rate of speed. Once the operator reaches the desired trim adjusted position, he merely shuts off the switch operating the pump 58 and its drive motor and the outboard motor 11 will be retained in its trim adjusted position. As has been previously noted, popping up operation if an underwater obstacle is struck may be accomplished by opening of the absorber valve 42. In addition, the absorber valve 42 will be effective to resist popping up under reverse drive thrust since the ball check valves 47 will be held in their closed position and no fluid can be displaced into the piston chamber portion 27, as aforenoted.

If the operator rather than desiring to achieve a trim adjustment, desires to achieve tilt-up, the switch is maintained in an opened position to continue to drive the pump 58 to pressurize the tilt/trim up line 68. When this occurs, upward movement of the trim piston 29 and tilt piston 32 continues in unison until the trim piston 29 reaches the upper end of its stroke at which time the valve plate 52 will be engaged with the end of the cylinder assembly 23 and the check valves 47 will be opened. This, effectively, stops the upward movement of the trim piston 29.

When this occurs, the continued exertion of fluid pressure in the chamber portion 28 of the cylinder 23 will act directly on the floating piston 44 which can then move upwardly to displace fluid from the trim piston chamber portion 33 through the passages 46 to the cylinder chamber portion 27 and return through the port 72. When this action occurs, the motion of the outboard motor 11 will be much more rapid since the tilt piston 32 has a substantially lesser effective area than the trim piston 29 and tilt piston 32 acting together. As a result, very rapid tilt up operation will occur.

If, at any time, there is an obstruction to upward movement, the pressure in the line 68 will increase sufficiently so as to permit the relief valve 78 to open since the check valve 81 will permit the pressure in the line 68 to communicate with the relief valve 78. The check valve 82 will, however, preclude any leakage to the line 69. In addition, the relief valve 76 may open if any other problem occurs or if the relief valve 78 does not relieve the pressure adequately.

Assuming that the operator desires to return the outboard motor 11 from its tilted up position as shown in the phantom line view in FIG. 1, the control switch is operated so as to rotate the fluid pump 58 and its powering electric motor in a direction so as to pressurize the port 61 and have the pump port 59 act as the return port. When this occurs, the line 63 will be pressurized and the shuttle piston 65 will move to the left to unseat the ball check valve 66 and permit the line 68 to function as a return line communicating with the pump line 62. In addition, the pressure acting on the check valve 67 will unseat it and permit the line 69 to experience pump pressure.

When this occurs, fluid will flow through the port 72 into the cylinder chamber portion 28. At this time, the trim piston 29 will still be at its upward position and the ball check valves 47 will be held open. Therefore, fluid will flow under pressure through the passages 46 to the trim piston chamber portion 33 and the pressure will act on the tilt piston 32 to force it downwardly within the trim piston 29.

This downward motion causes the floating piston 44 to move downwardly and displace fluid from the trim piston chamber portion 34 to the cylinder chamber portion 28 for return through the port 71 and return line 68 to the pump port 59. Again, if makeup fluid is required, it can be drawn from the reservoir 73 through the check valve 74.

This rapid downward tilting motion of the outboard motor 11 will continue until the floating piston 44 contacts the snap ring 45. At this time, the fluid pressure in the chamber 27 will rise and both the tilt piston 32 and trim piston 29 will move downwardly, continuing to displace fluid from the cylinder chamber portion 28 through the port 71. However, now the movement will be at a slower rate since a greater amount of fluid is required to move both the trim piston 29 and tilt piston 32 than the tilt piston 32 alone.

Once the operator reaches the desired trim adjusted position, the operation of the pump 58 is stopped. If, however, the operator does not stop the motor 58 and/or some restriction to downward movement is encountered, the pressure in the line 69 will increase and once sufficient pressure is generated, the relief valve 78 will open and relieve pressure. The check valve 82 opens under this condition and the check valve 81 will be closed. If too great a pressure is encountered for relief through the relief valve 78, the relief valve 77 will also open to relieve this excess pressure.

If the operator stops the trim down movement before the trim piston 29 reaches the end of its stroke, further trim down operation can be achieved at any time in the manner which is believed to be obvious, by operating the pump 58 so as to again pressurize the port 61. The driving thrust of the outboard motor 11 may be used to further assist in this trim down operation.

In conjunction with the trim down adjustment, there is a certain problem that exists with the prior art type of constructions and which may also exist with the embodiment of FIGS. 1–4. This problem will be discussed in conjunction with FIG. 5, which is a view showing another embodiments which is generally the same as the embodiment of FIGS. 1–4, but which solves this problem. Because of the basic similarity of the embodiment of FIG. 5 to the embodiment previously described, all components of this embodiment which are the same as the previously described embodiments have been identified by the same reference numerals and will not be described again, except insofar as is necessary to understand the construction and operation of this embodiment.

Figure 5:
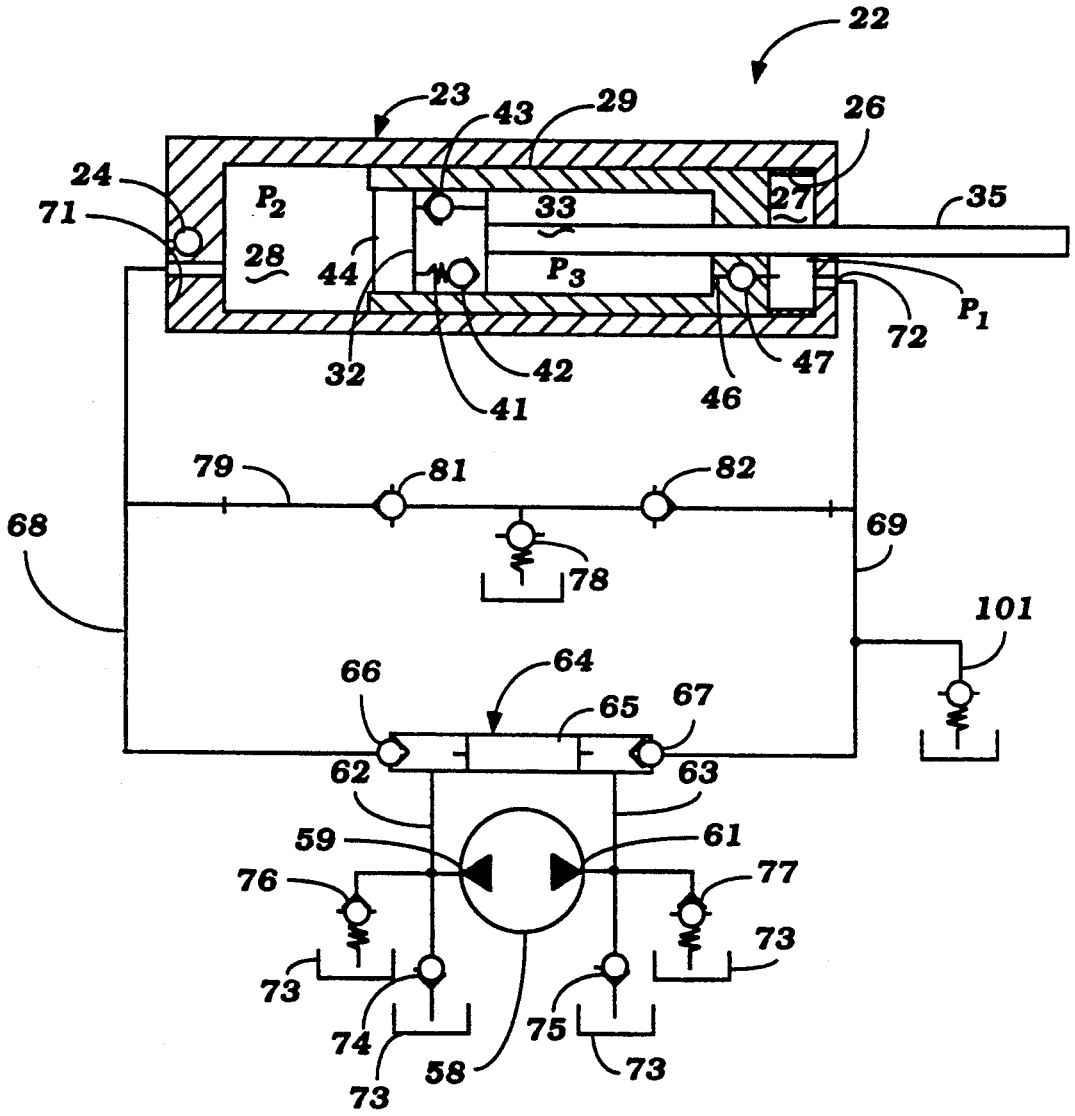
FIG. 5 is a schematic view, in part similar to FIG. 4, and shows another embodiment of the invention.

FIG. 5 illustrates the construction wherein the outboard motor 11 has been tilted down but is in a trim up adjusted position. If the operator decides to cause further trim down of the outboard motor, the pump 58 is operated, as aforenoted, so as to pressurize the port 61 and have the port 59 act as a return port. This will effect pressurization within the chamber portion 27 of the cylinder 23. However, either because of the presence of the check valves 47 in this embodiment or because of the restricted passageways 46 with the prior art constructions, the pressure in the trim piston chamber portion 33 ($P_3$) will not rise as rapidly as the pressure in the chamber 27, which pressure is indicated at $P_1$. As a result, a pressure $P_2$ may be generated in the chamber 28 that is greater than the pressure $P_3$ in the trim piston chamber portion 33. Thus, the tilt piston 32 may actually be forced up even though trim down operation is being called for. Hence, there may be some brief trim up occur before the desired trim down is reached.

In order to avoid this problem, a further pressure relief valve 101 is provided in the conduit 69 which functions to avoid the pressure $P_1$ rising too rapidly. This pressure is substantially lower than the pressure at which the relief valves 78 and 77 open. Hence, it will be ensured that the operator will not experience undesired trim up operation when trim down operation is being called for.

The same result may be achieved by tailoring the pressure at which the relief valves 78 or 77 open, or by controlling the motor operating the pump 58 in such a way so as to avoid too rapid a pressure rise.

It should be readily apparent from the foregoing descriptions that the preferred embodiments of the invention are extremely effective in providing good tilt and trim operation in a simple, concentric, unitary tilt and trim assembly. In addition, the popping up of the outboard drive under reverse operation is precluded and trim up operation when trim down operation is required may be avoided. Of course, the foregoing description is that of preferred embodiments of the invention and various changes and modifications may be made with departing from the spirit and scope of the invention, as defined by the appended claims.

What is claimed is:

1. A tilt and trim cylinder for a marine propulsion unit comprising a cylinder assembly defining an interior chamber, a trim piston received in said chamber and dividing said cylinder chamber only into first and second portions, said trim piston being formed with an internal chamber, a tilt piston received in said trim piston chamber and dividing said trim piston chamber into first and second portions, first conduit means for communicating said cylinder chamber first portion with said trim piston chamber first portion, second conduit means for connecting said cylinder chamber second portion with said trim piston chamber second portion, and means for precluding flow through said second conduit means in response to a predetermined condition.

2. A tilt and trim cylinder as set forth in claim 1 wherein the predetermined condition when flow through the second conduit means is precluded is a position of the trim piston.

3. A tilt and trim cylinder as set forth in claim 2 wherein flow is precluded through the second conduit means until the trim piston is at substantially the end of its trim adjusting stroke.

4. A tilt and trim cylinder as set forth in claim 3 wherein the means for precluding flow through the second conduit means is check valve means permitting flow from the second portion of the cylinder chamber to the second portion of the trim piston chamber and precluding flow in the opposite direction.

5. A tilt and trim cylinder as set forth in claim 4 further including means for opening the check valve when the trim piston is at the end of its trim adjusting stroke.

6. A tilt and trim cylinder as set forth in claim 1 further including shock absorbing means in said trim piston for permitting popping up of the marine propulsion unit when an underwater obstacle is struck by permitting flow from said second portion of said trim piston chamber to said first portion of said trim piston chamber when a predetermined force is exerted.

7. A tilt and trim cylinder as set forth in claim 6 wherein the predetermined condition when flow through the second conduit means is precluded is a position of the trim piston.

8. A tilt and trim cylinder as set forth in claim 7 wherein flow is precluded through the second conduit means until the trim piston is at substantially the end of its trim adjusting stroke.

9. A tilt and trim cylinder as set forth in claim 8 wherein the means for precluding flow through the second conduit means is check valve means permitting flow from the second portion of the cylinder chamber to the second portion of the trim piston chamber and precluding flow in the opposite direction.

10. A tilt and trim cylinder as set forth in claim 9 further including means for opening the check valve when the trim piston is at the end of its trim adjusting stroke.

11. A tilt and trim cylinder as set forth in claim 1 further including a hydraulic pump and hydraulic circuit for selectively pressurizing only one of the first or second portion of the cylinder chamber and opening the other of the first or second portion of the cylinder chamber to return.

12. A tilt and trim cylinder as set forth in claim 11 further including means for connecting the cylinder assembly to one of the marine propulsion unit and an associated watercraft and means for connecting the tilt piston to the other of the marine propulsion unit and associated watercraft.

13. A tilt and trim cylinder as set forth in claim 2 further including shock absorbing means in said trim piston for permitting popping up of the marine propulsion unit when an underwater obstacle is struck by permitting flow from said second portion of said trim piston chamber to said first portion of said trim piston chamber when a predetermined force is exerted.

14. A tilt and trim cylinder as set forth in claim 13 further including an imperforate floating piston contained within the first trim piston chamber portion and adapted to abuttingly engage the tilt piston for controlling the position of the tilt piston.

15. A tilt and trim cylinder as set forth in claim 14 wherein the predetermined condition when flow through the second conduit means is precluded is a position of the trim piston.

16. A tilt and trim cylinder as set forth in claim 15 wherein flow is precluded through the second conduit means until the trim piston is at substantially the end of its trim adjusting stroke.

17. A tilt and trim cylinder as set forth in claim 16 wherein the means for precluding flow through the second conduit means is check valve means permitting flow from the second portion of the cylinder chamber to the second portion of the trim piston chamber and precluding flow in the opposite direction.

18. A tilt and trim cylinder as set forth in claim 17 further including means for opening the check valve when the trim piston is at the end of its trim adjusting stroke.

19. A tilt and trim cylinder as set forth in claim 18 further including means for precluding a rapid rise in pressure in the second cylinder chamber portion for precluding upward movement of the marine propulsion unit when trim down is desired.

20. A tilt and trim cylinder for a marine propulsion unit comprising a cylinder assembly defining an interior chamber, a trim piston received in said chamber and dividing said cylinder chamber into first and second portions, said trim piston being formed with an internal chamber, a tilt piston received in said trim piston chamber and dividing said trim piston chamber into first and second portion, first conduit means for communicating said cylinder chamber first portion with said trim piston chamber first portion, second conduit means for connecting said cylinder chamber second portion with said trim piston chamber second portion, a hydraulic pump and hydraulic circuit for selectively pressurizing either said first or said second portion of said cylinder chamber, and means for precluding a rapid pressure rise in said second cylinder chamber portion for precluding upward movement of said tilt piston upon pressurization of said second cylinder chamber portion.

21. A tilt and trim cylinder as set forth in claim 20 wherein the means for precluding a rapid pressure rise in the second cylinder chamber portion comprises means for reducing the fluid pressure supplied thereto by the fluid pump.

22. A tilt and trim cylinder as set forth in claim 21 wherein the means for preventing the rapid pressure rise comprises a pressure relief valve.

* * * * *